US007602934B2

(12) United States Patent
Zuccaro

(10) Patent No.: US 7,602,934 B2
(45) Date of Patent: Oct. 13, 2009

(54) SPEAKER SYSTEM WITH BUILT-IN STORAGE OF SATELLITE SPEAKERS

(75) Inventor: Kevin Zuccaro, Simi Valley, CA (US)

(73) Assignee: Cerwin-Vega, Inc., Chatsworth, CA (US)

( * ) Notice: Subject to any disclaimer, the term of this patent is extended or adjusted under 35 U.S.C. 154(b) by 948 days.

(21) Appl. No.: 11/118,668

(22) Filed: Apr. 29, 2005

(65) Prior Publication Data

US 2006/0245612 A1 Nov. 2, 2006

(51) Int. Cl.
*H04R 1/02* (2006.01)

(52) U.S. Cl. ..... 381/386; 381/345; 381/351; 381/341

(58) Field of Classification Search ..... 381/87, 381/386, 332, 99, 334–336, 345, 351, 340–342, 381/339; 181/152, 199, 159, 177, 192, 194, 181/195

See application file for complete search history.

(56) References Cited

U.S. PATENT DOCUMENTS

| | | | | |
|---|---|---|---|---|
| 5,187,333 | A * | 2/1993 | Adair | 181/152 |
| 5,933,507 | A | 8/1999 | Woolley et al. | |
| 6,876,752 | B1 * | 4/2005 | Guenther | 381/386 |
| 6,968,067 | B2 * | 11/2005 | Lopez | 381/334 |
| 7,016,513 | B2 * | 3/2006 | Noselli | 381/386 |
| 2005/0123165 | A1 * | 6/2005 | Yang | 381/386 |

* cited by examiner

*Primary Examiner*—Vivian Chin
*Assistant Examiner*—Disler Paul
(74) *Attorney, Agent, or Firm*—Day Pitney LLP

(57) ABSTRACT

The disclosure relates to a satellite speaker system wherein the horn mouth of a main speaker, typically of a folded horn design, is divided by braces into satellite speaker storage chambers. This allows the satellite speakers to be placed into the storage chambers for storage and transportation, and then easily removed and placed into their remote locations for a show, performance or gig.

10 Claims, 3 Drawing Sheets

SPEAKER SYSTEM WITH BUILT-IN STORAGE OF SATELLITE SPEAKERS

BACKGROUND OF THE INVENTION

1. Field of the Invention

The present invention relates to a speaker system, such as those used for live performances, wherein the main speaker includes storage compartments for the satellite speakers, so that the speaker system can be easily transported.

2. Description of the Prior Art

In the prior art, speaker systems for live performances are well known. These systems typically include at least one main speaker along with a plurality of smaller satellite speakers. As these speaker systems are typically used for mobile or "on the road" applications, these speaker systems are frequently set up before a performance and, several hours later, packed up after the performance for transportation to the site of a subsequent performance. This can be an unwieldy and time-consuming process and, under the worst circumstances, can result in the satellite speakers becoming separated and misplaced from the main speaker. Additionally, these speaker systems have typically been large and unwieldy, and therefore difficult to transport in motor vehicles.

OBJECTS AND SUMMARY OF THE INVENTION

It is therefore an object of the present invention to provide a speaker system which can quickly be set up before a performance and quickly collapsed and packed up after a performance.

It is therefore a further object of the present invention to provide a speaker system with a design which conserves space and is therefore less difficult to handle and transport.

It is therefore a further object of the present invention to provide a speaker system wherein the satellite speakers are stored and transported with the main speaker system, so that the satellite speakers do not become separated therefrom.

These and other objects are attained by providing a main speaker with lower storage compartments, typically in the horn mouth, into which the satellite speakers fit during storage and transportation. When the satellite speakers are removed from the main speaker for the performance, the space into which the satellite speakers are otherwise stored serves as a horn mouth for the folded horn configuration of the main speaker.

DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
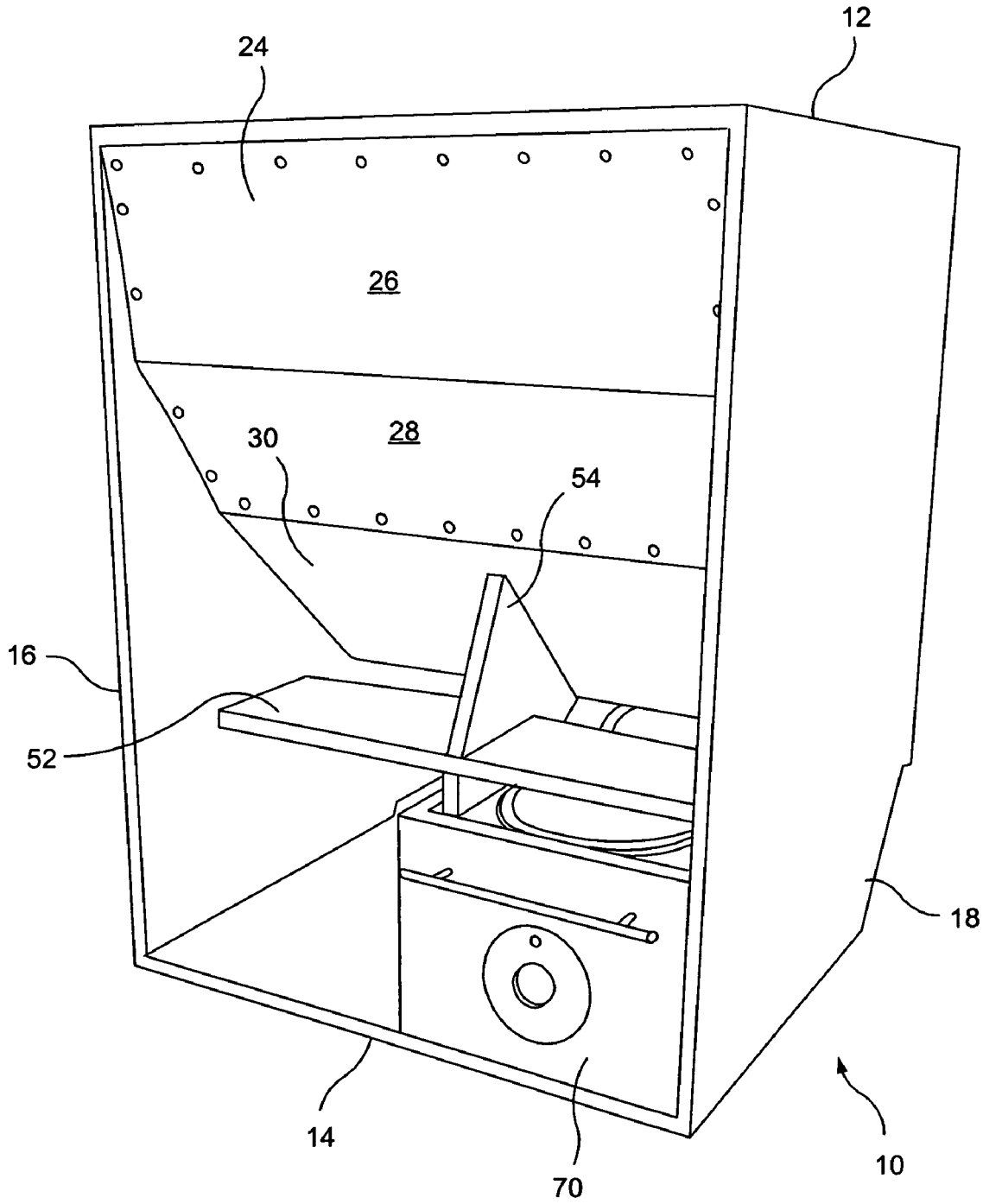
FIG. 1 is a perspective view of the main speaker of the present invention, shown with a single satellite speaker in the storage location.
Figure 2:
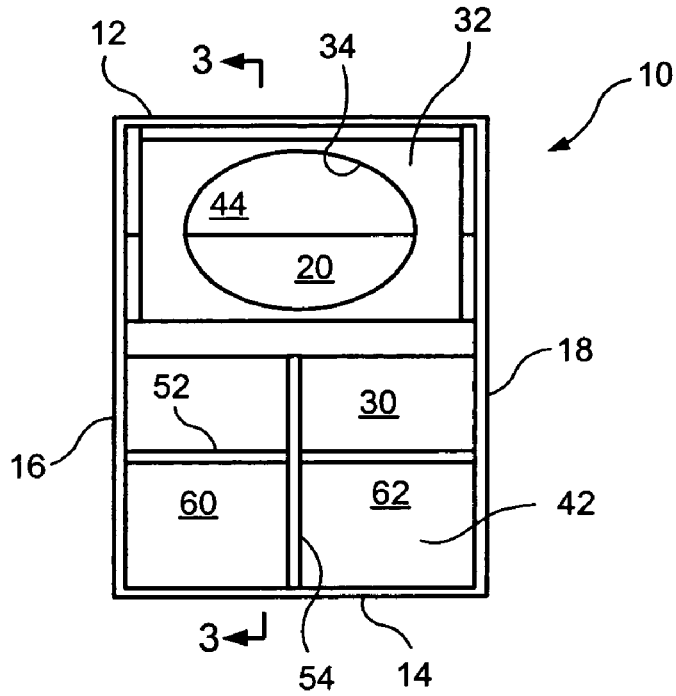
FIG. 2 is a front plan view of the main speaker of the present invention, shown with the front cover removed to expose the woofer baffle.
Figure 3:
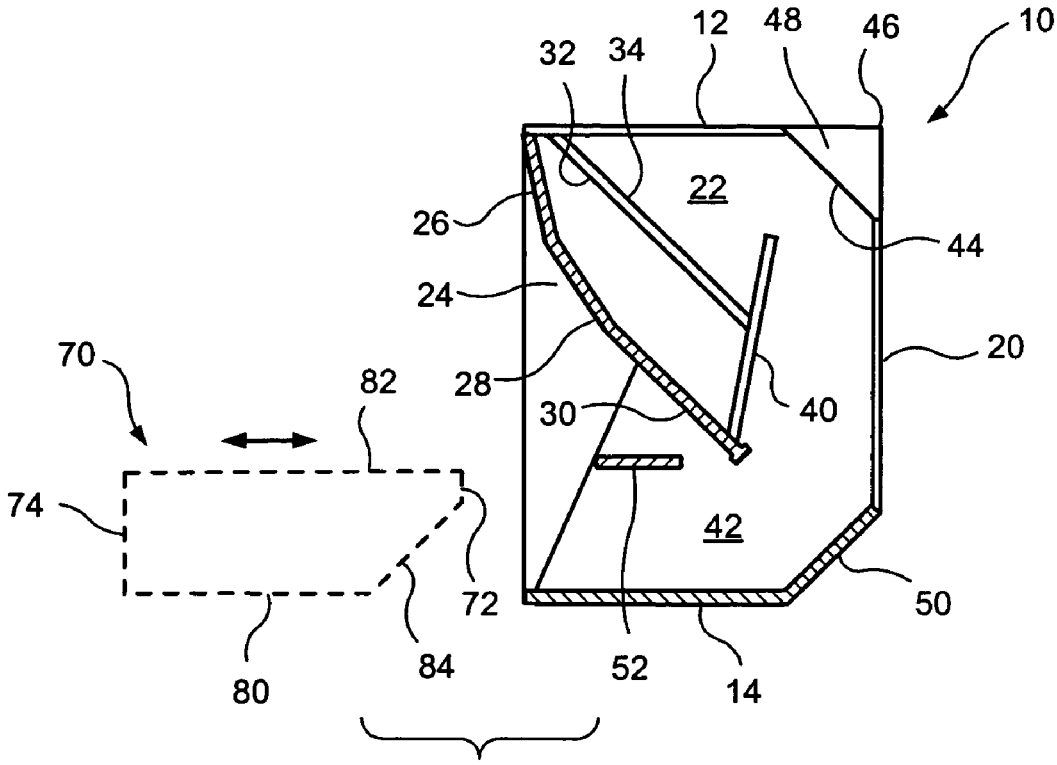
FIG. 3 is a cross-sectional view of plane 3-3 of FIG. 1, further shown with a satellite speaker in an exploded phantom configuration.
Figure 4:
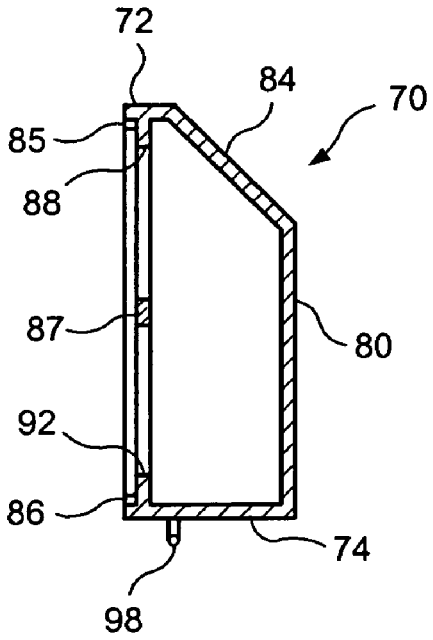
FIG. 4 is a side cross sectional view of a satellite speaker of the present invention.
Figure 5:
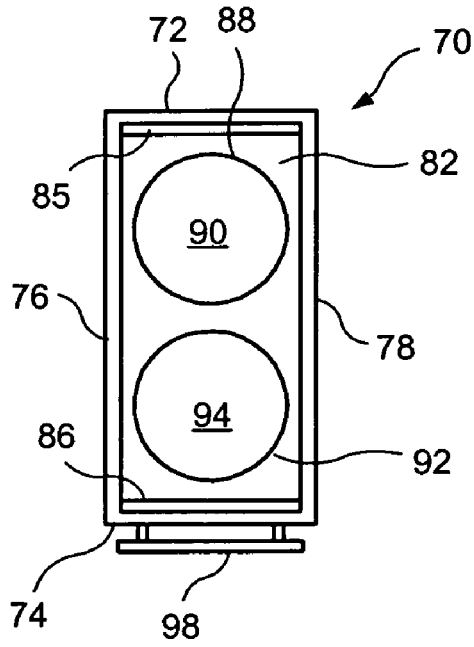
FIG. 5 is a front plan view of the satellite speaker of the present invention.
Figure 6:
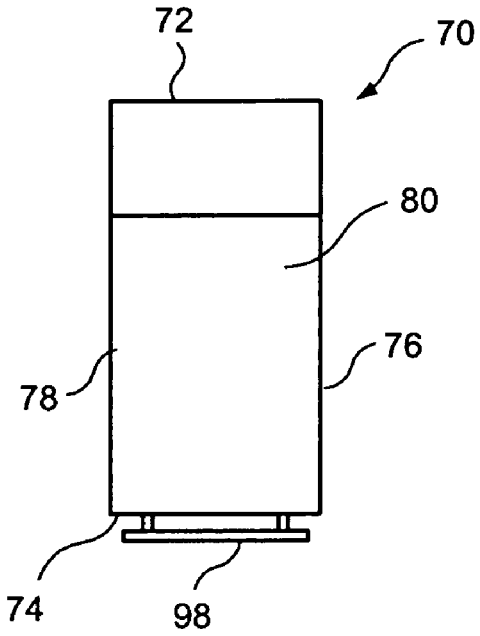
FIG. 6 is a rear plan view of the satellite speaker of the present invention.
Figure 7:
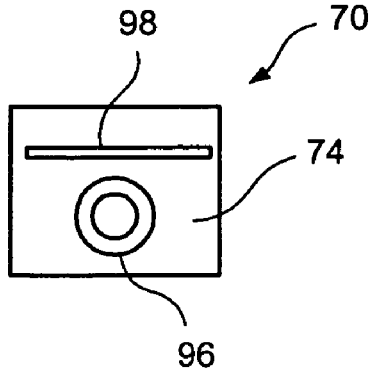
FIG. 7 is a bottom plan view of the satellite speaker of the present invention.

Referring now to the drawings in detail wherein like numerals indicate like elements throughout the several views, one sees that FIGS. 1-3 are various views of the main or primary speaker 10 of the present invention. Main speaker 10 is bounded by top wall 12, bottom wall 14, side walls 16, 18 and rear wall 20. Main speaker 10 is typically of a folded horn design with an upper chamber 22 bounded by removable cover 24 which comprises top cover portion 26 and bottom cover portion 28. Removable cover 24 is secured in place by cleats. Upper chamber 22 is further bounded by chamber bottom panel 30 which is a relatively permanent part of the structure. Woofer baffle 32 diagonally bisects upper chamber 22 from inwardly of the forward edge of top surface 12 and further includes an oval-shaped aperture 34 for the woofer speaker (not shown). Woofer baffle 32 extends to second baffle 40 which is oriented in accordance with the folded horn design. Downward of upper chamber 22 is horn mouth 42 through which a substantial portion of the sound from the woofer main speaker 10 is directed outwardly. Upper rear diagonal panel 44 is formed at the rear corner 46 where top panel 12 and rear panel 20 meet. Additionally, amplifier 48 may be inserted in the space between upper diagonal panel 44 and rear corner 46. Amplifier 48 receives electrical or electronic signals from microphones, musical instruments or other devices (not shown) and increases the voltage level in order to provide signals to the various speakers. Amplifier 48, additionally, could include analog-to-digital or digital-to-analog converters. Lower rear diagonal panel 50 is formed in place of the corner between rear wall 20 and bottom wall 14. Upper and lower rear diagonal panels 44, 50 help direct the sound from upper chamber 22 through horn mouth 42.

As shown in FIGS. 1 and 3, horn mouth 42 is bounded on a portion of its upper side by horizontal horn mouth brace 52. Similarly, horn mouth 42 is bisected by vertical horn mouth brace 54 which extends diagonally from a forward edge of lower panel 14 to chamber bottom panel 30.

Horizontal and vertical horn mouth braces 52, 54 therefore form two satellite speaker storage chambers 60, 62 in horn mouth 42.

Satellite or secondary speaker 70 is shown in FIGS. 4-7, as well as in phantom in FIG. 3. Satellite speakers 70 typically come in pairs, but various applications may require various numbers of satellite speakers 70.

Satellite speakers 70 include top wall 72, bottom wall 74, side walls 76, 78, rear wall 80 and front wall 82. Additionally, rear beveled wall 84 is formed in place of a corner between top wall 72 and rear wall 80. Front wall 82 includes grill cleats 85, 86 on the top and bottom edges thereof for retaining grill 87 (see FIG. 4) thereto. Additionally, front wall 82 includes top aperture 88 for retaining a coaxial driver 90 and a bottom aperture 92 for retaining a neodymium driver 94. In the illustrated embodiment, both the coaxial driver 90 (with a compression driver therebehind) and the neodymium driver 94 (which is typically non-coaxial) can be chosen as having an eight inch diameter. This typically results in performance which is comparable to a single ten-inch driver, but in a narrower configuration of satellite speaker which is advantageous in reducing the required width of the satellite speaker storage chambers 60, 62. Likewise, the use of a neodymium driver 94 reduces the weight of the magnets which may otherwise be disadvantageous in a dual driver design. Those skilled in the art will recognize that various driver configurations are available for various applications, and may be chosen for such considerations as conservation of both weight and space.

The exterior of bottom wall 74 includes pole mount 96 and handle 98. Pole mount 96 is used for mounting satellite speaker 70 onto a pole stand (not shown) as is well known to those skilled in the art. Handle 98 is used to insert and withdraw satellite speakers 70 into satellite speaker storage chambers 60, 62 as shown in FIGS. 1 and 3.

As can be seen from FIG. 3, when satellite speakers 70 are stored in satellite speaker storage chambers 60, 62, rear beveled wall 84 of satellite speakers 70 abut lower rear diagonal panel 50 of main speaker 10. Likewise, horizontal horn mouth brace 52 is spaced from bottom wall 14 of main speaker 10 to accommodate the depth of satellite speaker 70 and vertical horn mouth brace 54 is spaced from side walls 16, 18 to accommodate the width of satellite speakers 70.

Therefore, in the stored position, the satellite speakers 70 are in the position shown in FIG. 1. The musician or his crew grabs the handle 98 to withdraw the satellite speaker 70 from main speaker 10. The satellite speaker 70 is then placed in its appropriate remote location, typically mounted on a pole stand (not shown). After the performance, show, or gig is over, the musician or his crew can easily re-insert satellite speakers 70 into satellite speaker storage chambers 60, 62 and the speakers are ready for storage and/or transportation.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A speaker system, comprising:

a woofer;

a folded horn speaker enclosure;

said folded horn speaker enclosure comprising, an upper chamber;

a woofer baffle; said woofer baffle diagonally bisects said upper chamber;

said woofer mounted to said woofer baffle;

wherein the combination of said upper chamber, said woofer baffle, and said woofer form an enclosed volume;

a horn mouth, said horn mouth forming the lower front portion of said folded horn speaker enclosure;

at least one secondary speaker enclosure;

one or more speakers contained within said secondary at least one secondary speaker enclosure;

said at least one secondary speaker enclosure is operated in a location remote from said folder horn speaker enclosure; and wherein said folded horn speaker enclosure has at least one storage compartment formed within said horn mouth therein for said at least one secondary speaker enclosure to be stored when said at least one secondary speaker enclosure is not in use.

2. The speaker system of claim 1 wherein said at least one secondary speaker enclosure comprises a plurality of satellite speaker enclosures.

3. The speaker system of claim 1 wherein said at least one storage compartment comprises two storage compartments separated by a vertical brace in said horn mouth.

4. The speaker system of claim 3 wherein said satellite speakers include a rearward diagonal wall and said storage compartments include diagonal walls, wherein said rearward diagonal wall of said satellite speakers abuts said diagonal wall of said storage compartment when said satellite speakers are stored in said storage compartments.

5. The speaker system of claim 4 wherein said storage compartments are at a lower portion of said primary speaker.

6. The speaker system of claim 5 wherein said primary speaker includes an amplifier.

7. The speaker system of claim 6 wherein said amplifier powers said primary speaker and said satellite speakers.

8. The speaker system of claim 2 wherein a lower surface of said satellite speakers includes a handle for insertion and withdrawal of said satellite speakers from said storage compartments.

9. The speaker system of claim 2 wherein each of said satellite speakers includes a neodymium driver and a coaxial driver.

10. The speaker system of claim 9 wherein said neodymium driver is non-coaxial.

* * * * *